US005703601A

United States Patent [19]

Nalbandian et al.

[11] Patent Number: 5,703,601

[45] Date of Patent: Dec. 30, 1997

[54] DOUBLE LAYER CIRCULARLY POLARIZED ANTENNA WITH SINGLE FEED

[75] Inventors: Vahakn Nalbandian, Ocean, N.J.; Choon Sae Lee, Dallas, Tex.

[73] Assignee: The United States of America as represented by the Secretary of the Army, Washington, D.C.

[21] Appl. No.: 709,790

[22] Filed: Sep. 9, 1996

[51] Int. Cl.[6] ..... H01Q 1/38

[52] U.S. Cl. ..... 343/700 MS; 343/770; 343/846

[58] Field of Search ..... 343/700 MS, 829, 343/846, 848, 767, 830, 770; H01Q 1/38

[56] References Cited

U.S. PATENT DOCUMENTS 4,131,892 12/1978 Munson et al. ..... 343/700 MS 4,131,893 12/1978 Munson et al. ..... 343/700 MS 4,783,661 11/1988 Smith ..... 343/700 MS

*Primary Examiner*—Hoanganh T. Le

*Attorney, Agent, or Firm*—Michael Zelenka; John M. O'Meara

[57] ABSTRACT

A circularly polarized antenna is described having a ground plane and spaced conductive patches parallel to it forming lower and upper cavities. The lower cavity is excited by a coax introduced at an impedance matching point in the ground plane, and the upper cavity is energized by apertures in the middle patch. The sides of the lower cavity from which radiation does not emanate are shorted to the ground plane, and the sides of the upper cavity from which radiation does not emanate as shorted to the middle patch.

3 Claims, 5 Drawing Sheets

DOUBLE LAYER CIRCULARLY POLARIZED ANTENNA WITH SINGLE FEED

GOVERNMENT INTEREST

The invention described herein may be manufactured, used, sold imported and/or licensed by or for the Government of the United States of America without payment to us of any royalty thereon.

FIELD OF THE INVENTION

This invention relates to UHF and microwave antennas and more particularly to polarized antennas.

BACKGROUND OF THE INVENTION

Circularly polarized UHF and microwave antennas have been made by using two linearly polarized antennas placed perpendicularly to each other and feeding them 90° out of phase by a splitting network. More compact antennas made from microstrip have been constructed in which a single patch is energized in orthogonal modes by using a splitting network that feeds two inputs with signals of equal magnitude and a 90° phase difference. Further reduction in the size of the antenna has been obtained by feeding such an antenna at a single point. The operating frequency of an antenna that is fed at a single point lies between two slightly different resonant frequencies so as to excite orthogonal modes 90° out of phase. However, the desired 90° phase difference is a sensitive function of the frequency, and the frequency for the least input voltage standing wave ratio VSWR is not the same as the frequency for an optimum axial ratio. Consequently, the bandwidth of these single point fed antennas is very narrow.

In an article by H. A. Bethe entitled "Theory of Diffraction by Small Holes" published in Physical Review, Vl. 66, pp. 163–182 of 1944, the coupling of waveguides via small holes is described, and in a book by R. E. Collin entitled Foundations for Microwave Engineering published by McGraw-Hill in 1966, there is an explanation of the manner in which the fields of two cavities coupled via small holes may be 90° out of phase.

SUMMARY OF THE INVENTION

In accordance with this invention a circularly polarized antenna that may be made from microstrip is constructed with a ground plane and two spaced conductive patches that form upper and lower cavities. Excitation is by way of a coaxial cable having its sheath connected to the ground plane, and its central conductor connected to both patches. Holes in the patch nearer the ground plane serve to couple the cavity between it and the ground plane with the cavity between the two patches. In order to produce circularly polarized radiation, the excitation is such that the fields in the two cavities are perpendicular to each other, have equal magnitude, and a phase difference of 90°. The holes should be small enough to ensure 90° phase difference but big enough to have sufficient coupling between the lower and upper cavities. To ensure that the fields radiated by the two patches are perpendicular to each other, the nonradiating sides of the patch nearer the ground plane are connected to the ground plane, and the non radiating sides of the patch farther from the ground plane are connected to the other patch.

DETAILED DESCRIPTION

Figure 1A:
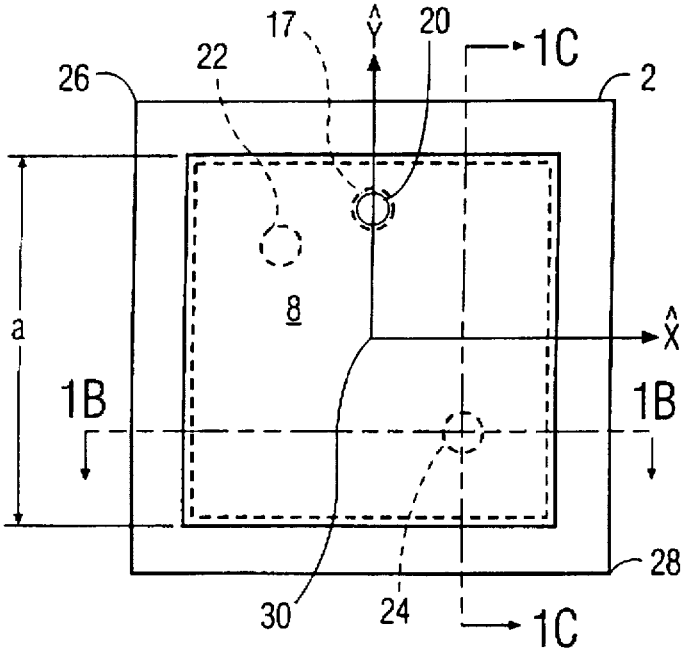
FIG. 1A is a top view of circularly polarized antenna of the invention.
Figure 1C:
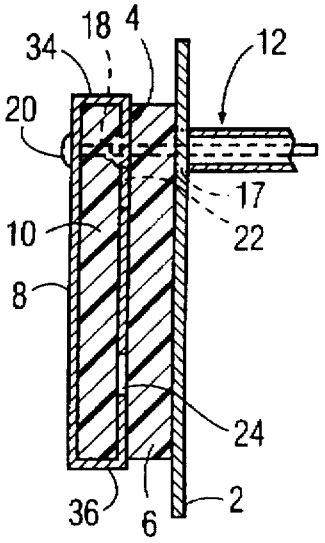
FIG. 1C is a cross sectional view 1C, 1C of FIG. 1A.
Figure 1B:
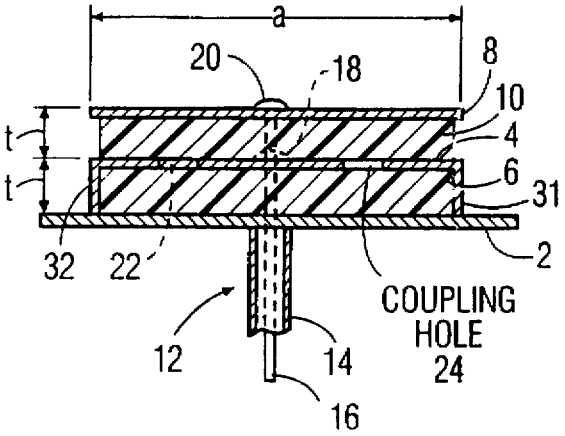
FIG. 1B is a cross sectional view 1B, 1B of FIG. 1A.

The embodiment of the circularly polarized antenna of this invention shown in FIGS. 1A, 1B and 1C is comprised of a conductive ground plane 2, a conductive patch 4 spaced from the ground plane 2 so as to form a cavity 6 and a conductive patch 8 spaced from the patch 4 so as to form a cavity 10. The ground plane is shown as being square, but it could have any shape, as is known to those skilled in the art. The patches 4 and 8 are squares of the same size, and their respective sides are parallel. If the patches 4 and 8 are sufficiently rigid, the cavities 6 and 10 may be filled with air, but if the antenna is fabricated from microstrip, the cavities 6 and 10 may be filled with a solid dielectric or insulating material such as Duroid™.

In this structure, the lower cavity 6 is energized via a coaxial line 12 having its sheath 14 electrically connected to the ground plane 2 and its central conductor 16 electrically connected to the patch 4 as indicated at 18. This electrical connection is preferably located along the Y axis such as to provide an impedance match between the coaxial line 12 and the cavity 6 along the Y axis of FIG. 1A. In order to aid in preventing undesirable modes from occurring in the cavity 10, the central conductor 16 extends thereacross to the patch 8 and is electrically connected thereto as indicated at 20. This short circuit between the patches 4 and 8 could, of course, be provided by a conductor other than the central conductor 16 however, the connections relating thereto on the patches 4 and 8, must be located along lines which pass through the centers of the patches 4 and 8.

The upper cavity 10 is energized via apertures 22 and 24 in the conductive patch 4 which, as seen in FIG. 1A, are located along a diagonal and respectively half way between the corners 26 and 28 and its center 30. These are the optimum locations for maximum coupling with the smallest hole sizes. It is important that the holes 22 and 24 be small enough to cause the fields in the cavities 6 and 10 to be orthogonal and yet large enough that they have the same strength. The holes 22 and 24 do not need to be circular.

Figure 2:
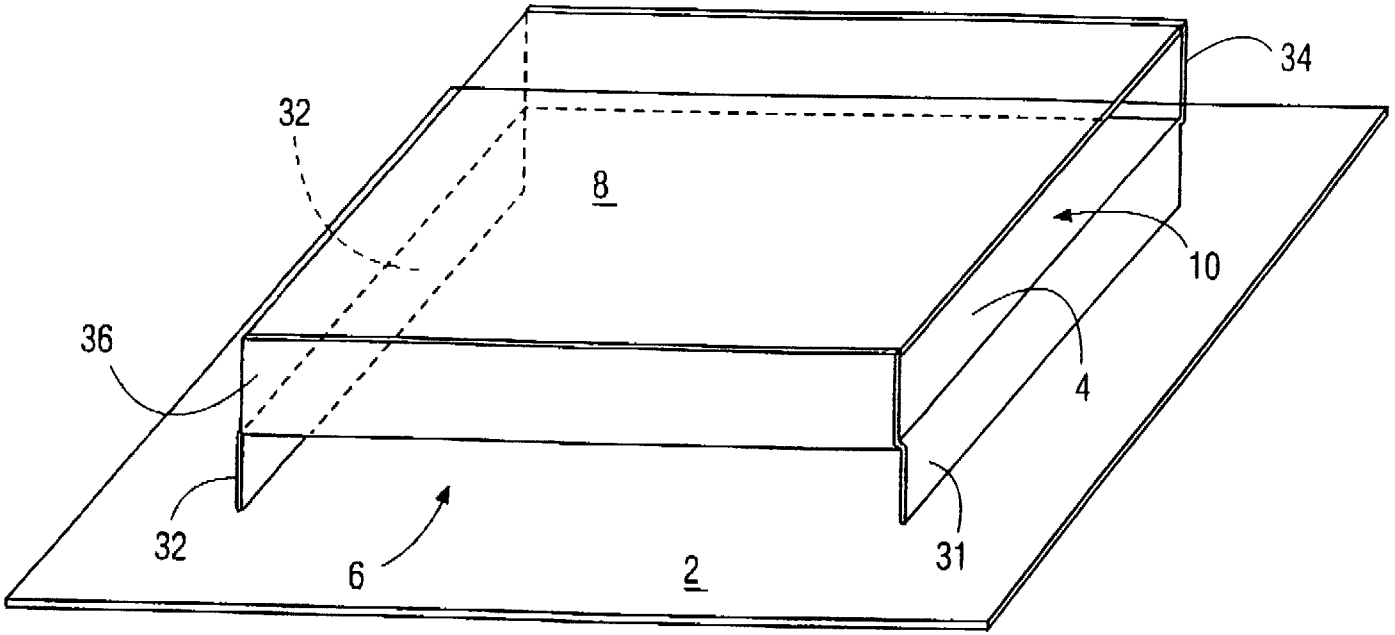
FIG. 2 is an isometric drawing of a circularly polarized antenna of the invention.

Another condition for producing circularly polarized radiation is that the fields radiating from the cavity 6 be perpendicular to those radiating from the cavity 10. To ensure that this requirement is satisfied, the sides of the cavities 6 and 10 from which radiation theoretically does not emanate are preferably short circuited to the ground plane 2. This can be effected in a number of ways, but FIG. 2 shows how easily it can be done when fabricating the antenna from microstrip in accordance with an aspect of the invention. All four edges of the patch 4 are extended so as to form flaps 31 and 32 which serve as a first pair of opposed sides for cavity 6, and flaps 34 and 36 which serve as a second pair of opposed sides for cavity 10. Although not shown in order to clarify FIG. 2, the cavities 6 and 10 respectively between the patch 4 and the ground plane 2 and between the patches 4 and 8 contain electrically insulating material such as Duroid™. The flaps 31 and 32 are bent downward and electrically connected to the ground plane 2. The flaps 34 and 36 are bent upward and are electrically connected to the patch 8.

Figure 3:
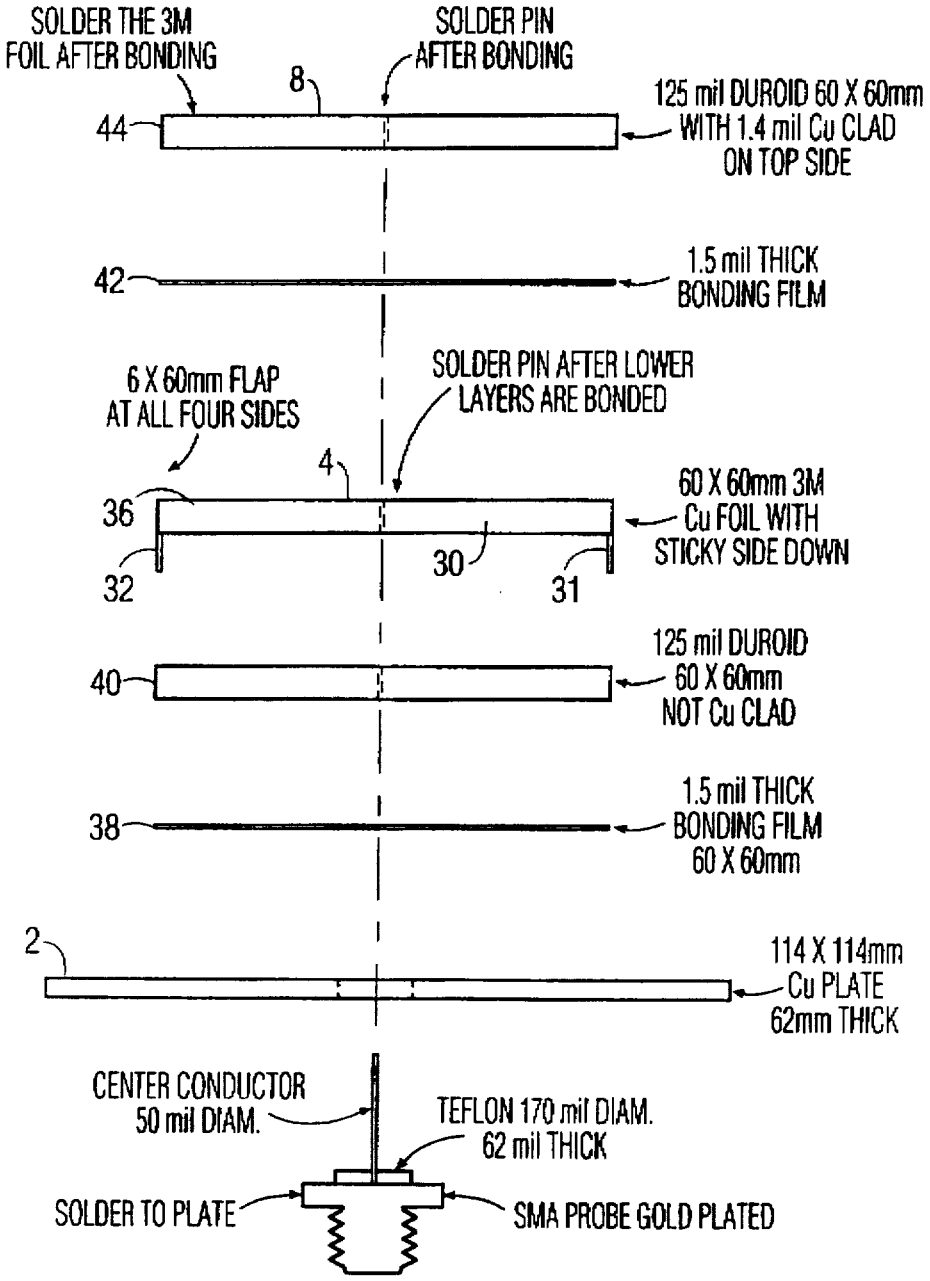
FIG. 3 is an exploded view of the layers of material used in fabricating one embodiment of the invention.

Reference is made to FIG. 3 for a description of constructional materials used in one embodiment of a circularly polarized antenna of the invention. The ground plane 2 is a 114 mm×114 mm copper plate that is 62 mils thick, and the x,y coordinates of the feed point 19 indicated in FIG. 1A are 0 and 20 mm. A 1.5 mil 60 mm×60 mm bonding film 38 adheres a 60 mm×60 mm Duroid™ layer 40 having a thickness of 125 mils to the ground plane 2. The Duroid™ layer 40 and all other layers to be described are centered on the ground plane 2 with their edges parallel to its edges. The patch 4 is a 60 mm×60 mm copper foil having a sticky side for adhering it to the Duroid layer™ 40. The flaps 31, 32 and 36 extending from the sides of patch 4 are shown, but the flap 34 is not seen in this view. The width of these flaps is the same as the thickness of the Duroid™ layer 40, i.e. 125 mils. A 60 mm×60 mm 1.5 mil thick bonding film 42 adheres a 60 mm×60 mm Duroid™ layer 44 of 125 mil thickness to the patch 4. The patch 8 is formed by the Duroid™ layer 44 being clad with copper having a thickness of 1.4 mils.

Figure 4:
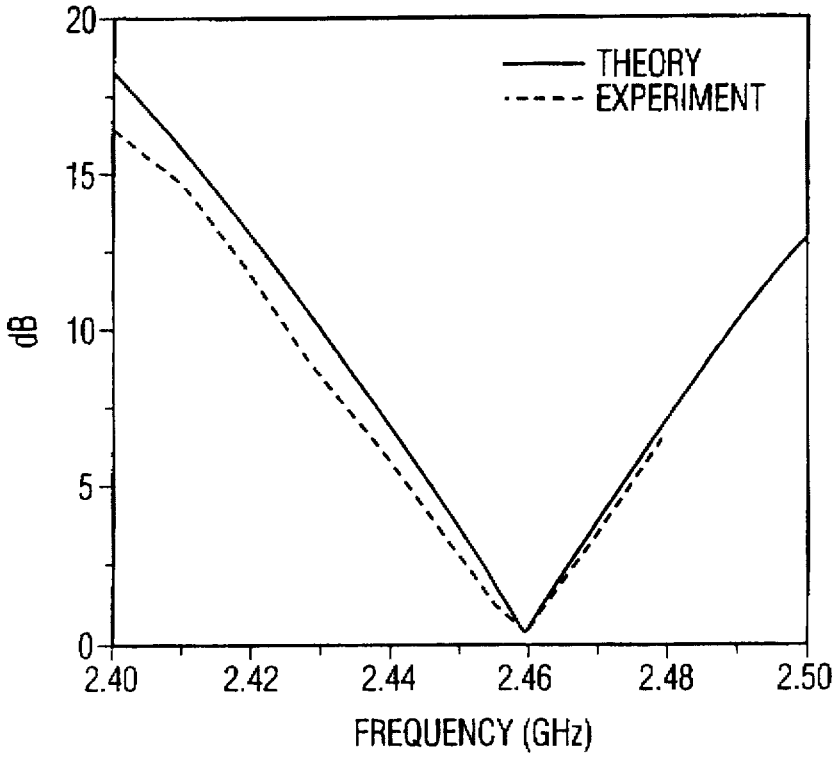
FIG. 4 shows the measured axial ratio as a function of frequency near the resonant frequency in comparison with theoretical results.

FIG. 4 shows the measured axial ratio as a function of frequency near the resonant frequency in comparison with the theoretical results for an antenna constructed as just described. A relatively good agreement is observed. The measured frequency for an optimum axial ratio is 2.46 GHz, which is within 0.6% of the measured resonant frequency for the least input VSWR (2.446 GHz). The measured input VSWR for the optimum axial ratio is 1.39, compared with 1.13 for the least VSWR. The measured 6-dB CP bandwidth is 1.63%, compared with the CP bandwidth of less than 1% reported by P. C. Sharma and K. C. Gupta IEEE trams. Antennas and Propagation, vol. AP-31, pp. 949–955, 1983 for comparable antennas.

Figure 5:
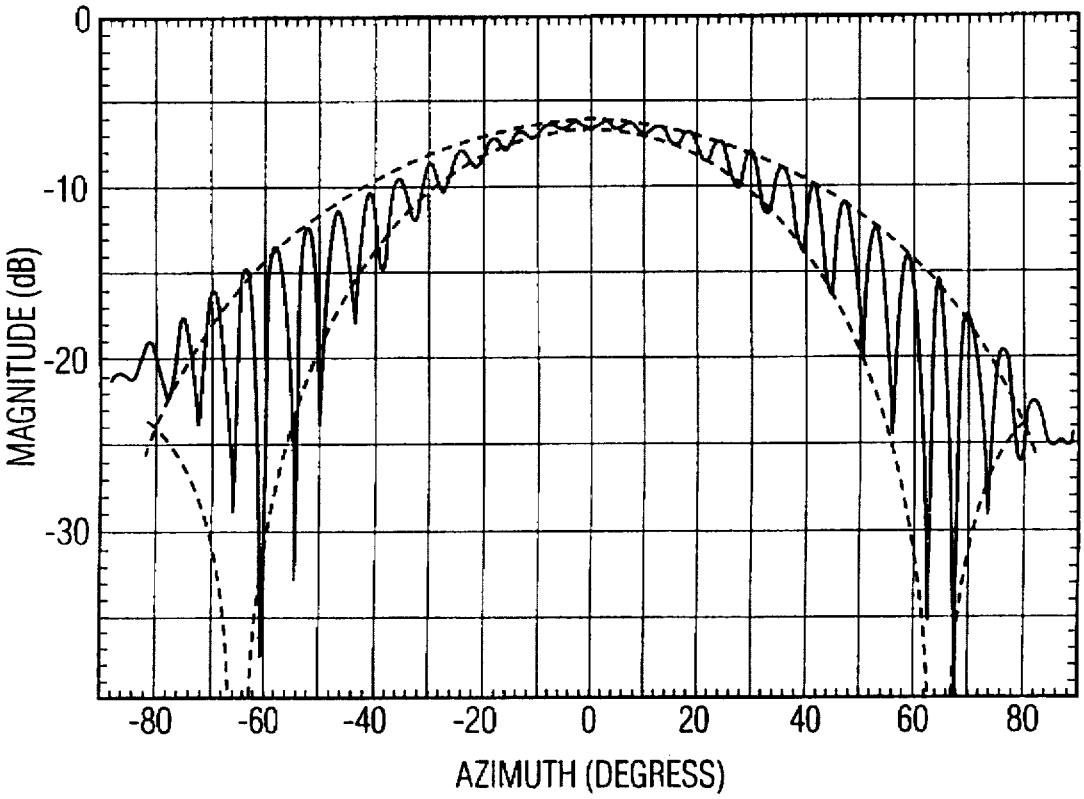
FIG. 5 shows the measured radiation pattern of an antenna of this invention.

FIG. 5 shows the measured radiation pattern for the antenna just described taken with a rotating linearly polarized receiver horn. The experimental data is in good agreement with the theoretical results. Here the effective patch length was not theoretically computed because of the non-conventional geometry of the microstrip environment. Instead, using the radiation angle at the minimum field of the minor axis of the polarization, the effective length was computed. The effective extended length was 3.6 mm on each side.

In order to produce circularly polarized radiation, the antenna of the present invention is excited such that the fields in the two cavities 6 and 10 are perpendicular to each other and have equal magnitudes and a phase difference of 90°. For the 90° phase shift, the lower cavity 6 is excited by the coaxial line 12 while the upper cavity is fed by coupling through the circular holes 22 and 24 in the middle patch 4. If the holes 22 and 24 are small enough, the device will provide field excitations in the two cavities that are 90° out of phase. However, the coupling holes should be large enough to ensure equal field amplitudes in the upper and lower resonant cavities.

Another condition for achieving circularly polarized radiation is that the fields radiated from the lower cavity 6 should be perpendicular to those from the upper cavity 10. To ensure that this requirement is satisfied, two nonradiating sides of the lower cavity 6 (those which in theory do not radiate) are shorted while the sides of the upper cavity 10 perpendicular to the shorted sides of the lower cavity 6 are blocked by conducting surfaces. Moreover, the central conductor 16 passes through the middle patch 4 to the top radiating patch 8 to suppress any unwanted mode excitation in the upper cavity 10. The conductor 16 in this case is in electrical contact with both the patch 4 and the patch 8, thus acting as feed for the lower cavity 6 and as a local short for the upper cavity 10. This arrangement facilitates the fabrication process.

The electric fields of the dominant modes in the lower and upper cavities of the present invention maybe approximated to be:

$$E = j\omega\mu C\cos\left(\frac{\pi}{a}x\right)\sin\left(\frac{\pi}{a}y\right)\hat{z} \text{ for the lower cavity} \tag{1}$$

and $$E = j\omega\mu D\sin\left(\frac{\pi}{a}x\right)\cos\left(\frac{\pi}{a}y\right)\hat{z} \text{ for the upper cavity} \tag{2}$$

where $\omega$ is the angular frequency, $\mu$ and $\epsilon$ are the permeability and permitivity of the dielectric or insulating medium, respectively, C and D are constants, and a is the linear dimension of the square patch. To obtain circularly polarized radiation at the zenith, the constants C and D must have equal magnitude with a phase difference of 90°. More specifically, for right-handed circular polarization (RHCP), D=−jC, and for left-handed circular polarization (LHCP), D=jC.

Considering only the dominant modes in the two resonating cavities coupled through a small hole located at $(x_1,y_1)$ on the middle metallic patch, the ratio of the field excitation in the upper cavity 8 to that in the lower cavity 6 is given by the following expression where $r_o$ is the aperture radius, and $k_r$ and Q are the wavenumbers at the loss-free resonant frequency and the quality factor of the upper cavity, respectively.

$$\frac{D}{C} = \frac{4r_0^3\sin\left(\frac{2\pi x_1}{a}\right)\sin\left(\frac{2\pi y_1}{a}\right)}{3a^2t\left[\left(\frac{k_r}{k}\right)^2-\left(1+\frac{1-j}{Q}\right)\right]} \tag{3}$$

Resonance will occur when the real part of the denominator on the right side of Eq. (3) vanishes, leading to the desired 90° phase difference between C and D, $$\frac{D}{C} = -j\frac{4}{3}Q\frac{r_0^3}{a^2t}\sin\left(\frac{2\pi x_1}{a}\right)\sin\left(\frac{2\pi y_1}{a}\right) \tag{4}$$

For maximum coupling between the cavities, the hole should be located at $|x1|=a/2$, i.e. at a diagonal position halfway between the patch center and one of the patch corners (see FIG. 1A). Two coupling holes 22 and 24, symmetrically placed with respect to the patch center on the same diagonal, may be used to increase the coupling by a factor of 2 without increasing the hole size. If the hole radius is then chosen according to the relation $$r_0 = \left(\frac{3}{8}\ \frac{a^2t}{Q}\right)^{\frac{1}{3}} \tag{5}$$

C and D will have equal magnitude, and circular polarization is achieved for the overhead direction (pattern maximum). Note that for large Q, the required hole becomes small. Furthermore Eq. (4) shows that the location (on the right or left leaning diagonal) will determine whether the polarization be right-handed or left-handed.

With a proper selection of the hole size for the present invention from the derivations above, those skilled in the art will understand that a perfect CP radiation with an axial ratio of 1 is realizable. Moreover, the frequency for the least axial ratio is the same as the resonant frequency for the optimum input VSWR, providing wider CP bandwidth without the input impedance mismatch. Since the value of C/D is independent of the feed location, the impedance matching procedure and CP design consideration can be separate and the antenna design process is simpler.

To ensure that the unwanted higher-order modes are not excited, especially in the upper cavity 10, two of the four side walls in the lower cavity 6 of the present invention should be blocked with a conducting copper foil and the two sides in the upper cavity that are perpendicular to the closed sides in the lower cavity were shorted (FIG. 1).

What is claimed is:

1. A circularly polarized antenna comprising:

first, second and third layers of conductive material, said second and third layers being rectangular and similarly oriented, with each having first and second pairs of opposed edges;

a first layer of electrically insulating material between said first and second layers of conductive material;

a second layer of electrically insulating material between said second and third layers of conductive material;

sheets of conductive material electrically connecting the first pair of opposed edges of said second layer of conductive material with said first conductive layer;

sheets of conductive material electrically connecting the second pair of opposed edges of said second and third layers of conductive material;

means defining first and second openings in said second layer of conductive material, said first and second openings being located along a diagonal of said second layer;

means defining a third opening in said first layer of conductive material;

a coaxial connector having a central conductor within a conductive sheath;

said conductive sheath being connected to the periphery of said third opening; and said central conductor being connected to said second and third layers of conductive material at an impedance matching point.

2. A circularly polarized antenna comprising:

a conductive ground plane;

a first square conducting member that is uniformly spaced from said ground plane;

a second square conducting member having the same size as said first square conducting member and uniformly spaced therefrom;

said first and second square conducting members each having peripheral edges which are aligned respectively in parallel;

conductive sheets connected between opposite edges of said first square conducting member and said ground plane;

conductive sheets connected between opposite edges of said second square conducting member, which are perpendicular to the opposite edges on said first square conducting member;

means defining holes in said first square conducting member at equal distances from its center and along a diagonal thereof;

means defining an opening in said ground plane; and a coaxial connector having a ring electrically connected to the periphery of the opening in said ground plane and a central conductor extending perpendicularly through said opening in said ground plane and making electrical contact with said first and second square conducting members, said conductor being located so as to provide an impedance match.

3. A circularly polarized antenna as set forth in claim 2 further comprising:

extensions of the edges of said second square conducting member; and wherein said sheets of conducting material are formed from said extensions.

* * * * *